US008041237B2

(12) United States Patent
Yamanaka et al.

(10) Patent No.: US 8,041,237 B2
(45) Date of Patent: Oct. 18, 2011

(54) FIXING APPARATUS WITH PRESSURE STATE DETECTION AND CONTROL

(75) Inventors: Takashi Yamanaka, Osaka (JP); Atsushi Ide, Osaka (JP); Kimihide Tsukamoto, Osaka (JP); Hiroshi Nakatani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 378 days.

(21) Appl. No.: 12/470,583

(22) Filed: May 22, 2009

(65) Prior Publication Data

US 2009/0297196 A1 Dec. 3, 2009

(30) Foreign Application Priority Data

May 27, 2008 (JP) ..... 2008-138183

(51) Int. Cl.
*G03G 15/20* (2006.01)

(52) U.S. Cl. ..... 399/33

(58) Field of Classification Search ..... 399/33, 399/67, 328, 331; 219/216
See application file for complete search history.

(56) References Cited

U.S. PATENT DOCUMENTS

| | | | | |
|---|---|---|---|---|
| 7,039,332 | B2 * | 5/2006 | Suzuki | 399/45 |
| 7,392,004 | B2 * | 6/2008 | Sato et al. | 399/328 |
| 7,620,337 | B2 * | 11/2009 | Nakamoto et al. | 399/69 |
| 7,643,785 | B2 * | 1/2010 | Matsubara et al. | 399/329 |
| 7,653,321 | B2 * | 1/2010 | Yoshikawa | 399/67 |
| 7,664,415 | B2 * | 2/2010 | Mikutsu | 399/67 |
| 2009/0297181 | A1 * | 12/2009 | Yamanaka et al. | 399/33 |

FOREIGN PATENT DOCUMENTS

| | | | |
|---|---|---|---|
| JP | 58217976 | A * | 12/1983 |
| JP | 59-036275 | | 2/1984 |
| JP | 59034575 | A * | 2/1984 |
| JP | 06083232 | A * | 3/1994 |
| JP | 08016023 | A * | 1/1996 |
| JP | 2002040863 | A * | 2/2002 |
| JP | 2003091202 | A * | 3/2003 |
| JP | 2003-280308 | | 10/2003 |
| JP | 2004-010192 | | 1/2004 |
| JP | 2006-215173 | | 8/2006 |
| JP | 2007-272158 | | 10/2007 |
| JP | 2008-039970 | | 2/2008 |

* cited by examiner

*Primary Examiner* — Robert Beatty
(74) *Attorney, Agent, or Firm* — Renner, Otto, Boisselle & Sklar, LLP

(57) ABSTRACT

In one embodiment, a fixing apparatus is configured of a pressing portion for causing the pressure roller to enter a pressure applied state by applying bias, a switching portion for causing the pressing portion in the pressure applied state to enter a pressure released state by causing a cam to rotate forward, a pressure state detection portion for detecting the pressure released state, and a control portion for, when shifting from the pressure applied state to the pressure released state, turning forward the cam of the switching portion in the pressure applied state and stopping the cam after the pressure state detection portion detects the pressure released state. If the cam is turned forward with respect to the switching portion for a certain time period, but the pressure state detection portion does not detect the pressure released state, the control portion performs forward rotational direction retry control.

7 Claims, 11 Drawing Sheets

FIXING APPARATUS WITH PRESSURE STATE DETECTION AND CONTROL

CROSS-REFERENCE TO RELATED APPLICATIONS

This application claims priority under 35 U.S.C. §119(a) on Patent Application No. 2008-138183 filed in Japan on May 27, 2008, the entire contents of which are herein incorporated by reference.

BACKGROUND OF THE INVENTION

1. Field of the Invention

The present invention relates to a fixing apparatus used in an image forming apparatus and the like.

2. Related Art

In an image forming apparatus and the like using an electrophotographic method that is widely applied in copying machines, laser printers, facsimiles, and the like, conventionally, a fixing method used in a fixing apparatus is generally a heat fixing method. For such a heat fixing method, a hot roller fixing method using a hot roller is generally applied.

With the hot roller fixing method, a hot roller, that includes an internal heater as a heat source and an external surface covered with rubber or resin having good releasability, and a pressure roller are pressed against each other so that a nip portion is formed between these rollers. Then, a transfer paper on which a toner image has been formed is caused to pass through the nip portion so that the toner is heated and melted. Thereby, the toner is fused and fixed onto the transfer paper. The hot roller fixing method is suitable for increasing speeds because the entire hot roller is maintained at a predetermined temperature.

In the fixing apparatus using the aforementioned hot roller and pressure roller, the pressure roller is pressed against the hot roller so that a fixing operation is reliably performed. Consequently, in the fixing apparatus using the hot roller and the pressure roller, a pressing means is generally used so that a pressure applied state in which the pressure roller is pressed against the hot roller can be formed.

The pressing means has a configuration in which, for example, bias is applied to the pressure roller via a spring or the like with respect to the hot roller, and the pressure roller is pressed against the hot roller so as to enter a pressure applied state.

In the image forming apparatus using the fixing apparatus including the aforementioned pressing means, when warming up or being on standby, operations in the image forming apparatus having been stopped, or the like, if the pressure roller is maintained for a long time in a state in which the pressure roller is pressing against the hot roller, the surface of the hot roller or the like may possibly be deformed.

Consequently, if the time period when the fixing apparatus does not perform a fixing operation is of a certain length, pressure applied by the pressure roller against the hot roller is released so that the high quality performance of the fixing apparatus can be maintained. Accordingly, in the fixing apparatus using the hot roller and the pressure roller, in order to switch between a pressure applied state in which the pressure roller is pressed against the hot roller and a pressure released state in which such pressure is released, a switching means capable of switching between the pressure applied state and the pressure released state with respect to the aforementioned pressing means is generally used (for example, see JP 2003-280308A).

The switching means switches between a pressure release operation and a pressure application operation as described above. The pressure release operation is an operation for shifting from the pressure applied state to the pressure released state with respect to the pressing means in the pressure applied state. On the contrary, the pressure application operation is an operation for shifting from the pressure released state to the pressure applied state with respect to the pressing means in the pressure released state.

Such a switching means is a means that, for example, includes a turnable cam with respect to the pressing means as described in the above example and switches to the pressure released state in which pressure applied by the pressure roller against the hot roller is reduced by turning the cam in a forward rotational direction with respect to the pressing means that is in the pressure applied state so that the pressure roller applies pressure to the pressing means in a direction opposite to the direction in which the bias is applied to the pressure roller so as to press the pressing means back. Also, the means switches to the pressure applied state by turning the cam in a backward rotational direction with respect to the pressing means that is in the pressure released state so as to release the pressure to the pressing means.

If the switching means including such a turnable cam as described above is used in the aforementioned fixing apparatus, the cam needs to be turned in order to perform switching. When the cam is turned, some problem or the like may occur to the mechanism of the cam so that the mechanism enters a locked state. Accordingly, there may be a case in which operations cannot be performed using the cam.

In order to forcibly turn the cam when such a state occurs, it is necessary to use a larger scaled motor or the like to turn the cam than necessary; thus, the cost of the fixing apparatus may possibly increase.

In general, as for a mechanism that turns in the forward rotational direction or the backward rotational direction, if the mechanism enters a locked state, it is a well known fact that the operations of the mechanism are often recovered by turning the mechanism once in a rotation direction opposite to the rotation direction before entering the locked state and, thereafter, turning again in the rotation direction before entering the locked state and the like.

SUMMARY OF THE INVENTION

The present invention intends to provide a fixing apparatus that has a mechanism including a turnable cam as described above and is capable of recovering the operations of a mechanism with ease even if the mechanism enters a locked state due to some problem or the like having occurred to the mechanism.

The fixing apparatus of the present invention is a fixing apparatus that causes a recording material to pass through a nip portion formed by a rotating hot roller and a rotating pressure roller being in contact so as to perform a fixing operation to fix an unfixed image on the recording material, and the fixing apparatus includes a pressing portion (pressing means) for applying bias to the pressure roller toward the hot roller so as to create a pressure applied state by pressing the pressure roller against the hot roller, a switching portion (switching means), including a turnable cam, for switching to a pressure released state in which a pressing force applied by the pressure roller toward the hot roller is reduced by turning the cam in a forward rotational direction with respect to the pressing portion that is in the pressure applied state so that the pressure roller applies pressure to the pressing portion in a direction opposite to a direction in which the bias is applied to the pressure roller so as to press the pressing portion back, and switching to the pressure applied state by turning the cam in a backward rotational direction with respect to the pressing portion that is in the pressure released state so as to release the pressure to the pressing portion, a pressure state detection portion (pressure state detection means) for detecting the pressure applied state and the pressure released state, and a control portion (control means) for controlling processing for, when shifting from the pressure applied state to the pressure released state, turning the cam in the forward rotational direction with respect to the switching portion that is in the pressure applied state and stopping the cam after the pressure state detection portion detects the pressure released state, and when shifting from the pressure released state to the pressure applied state, turning the cam in the backward rotational direction with respect to the switching portion that is in the pressure released state and stopping the cam after the pressure state detection portion detects the pressure applied state. When shifting from the pressure applied state to the pressure released state, if the cam is turned in the forward rotational direction with respect to the switching portion that is in the pressure applied state for a first predetermined time period, but the pressure state detection portion does not detect the pressure released state, the control portion performs forward rotational direction retry control according to which the cam is again turned in the forward rotational direction after the cam is turned in the backward rotational direction for a second predetermined time period.

With such a configuration, the fixing apparatus including the switching portion having the mechanism using the turnable cam as described above can recover the operations of the switching portion with ease by performing the aforementioned forward rotational direction retry control even if some problem or the like occurred to the switching portion so that the switching portion enters a locked state. Thus, the stoppage of operations in the fixing apparatus can be easily suppressed. Furthermore, it is not necessary to use a larger scaled motor or the like to turn the aforementioned cam than necessary, thus enabling the suppression of increases in the cost of the fixing apparatus.

In the aforementioned fixing apparatus, it is preferable to set the aforementioned first predetermined time period so as to be sufficient for the pressure state detection portion to detect the pressure released state after the cam starts to turn in the forward rotational direction. In this case, the aforementioned second predetermined time period is set so as to be substantially as long as the aforementioned first predetermined time period. By doing this, the operations of the switching portion can be recovered in a rational manner even if some problem or the like occurs to the switching portion for the fixing apparatus so that the switching portion enters a locked state.

Further, in the aforementioned fixing apparatus, it is preferable that the control portion stops an operation in the fixing apparatus if forward rotational direction retry control is performed a predetermined number of times, but the pressure state detection portion does not detect the pressure released state.

By doing this, excessive force can be suppressed from being exerted onto the switching portion for the fixing apparatus for a long time.

Further, in the aforementioned fixing apparatus, the case of shifting from the pressure released state to the pressure applied state can also be handled similarly to the aforementioned case of shifting from the pressure applied state to the pressure released state.

That is, when shifting from the pressure released state to the pressure applied state, if the cam is turned in the backward rotational direction with respect to the switching portion that is in the pressure released state for a third predetermined time period, but the pressure state detection portion does not detect the pressure applied state, the control portion may perform backward rotational direction retry control according to which the cam is again turned in the backward rotational direction after the cam is turned in the forward rotational direction for a fourth predetermined time period.

By doing this, in the fixing apparatus including the switching portion having a mechanism using the turnable cam as described above, similarly to the aforementioned case of shifting from the pressure applied state to the pressure released state, also in the case of shifting from the pressure released state to the pressure applied state, even if some problem or the like occurs to the switching portion so that the switching portion enters a locked state, the operations of the switching portion can be recovered with ease by performing the aforementioned backward rotational direction retry control. Thus, the stoppage of operations in the fixing apparatus can be easily suppressed. Furthermore, it is not necessary to use a larger scaled motor or the like to turn the aforementioned cam than necessary, thus enabling the suppression of increases in the cost of the fixing apparatus.

When shifting from the pressure released state to the pressure applied state in the aforementioned fixing apparatus, it is preferable to set the third predetermined time period so as to be sufficient for the pressure state detection portion to detect the pressure applied state after the cam starts to turn in the backward rotational direction, and the fourth predetermined time period so as to be substantially as long as the third predetermined time period. By doing this, the operations of the switching portion can be recovered in a rational manner even if some problem or the like occurs to the switching portion for the fixing apparatus so that the switching portion enters a locked state.

Further, in the aforementioned fixing apparatus, it is preferable that the control portion stops an operation in the fixing apparatus if backward rotational direction retry control is performed a predetermined number of times, but the pressure state detection portion does not detect the pressure applied state.

By doing this, the exertion of excessive force onto the switching portion for the fixing apparatus for a long time can be suppressed.

According to the present invention, in the fixing apparatus, when shifting from the pressure applied state to the pressure released state, if the cam is turned in the forward rotational direction with respect to the switching portion that is in the pressure applied state for the first predetermined time period, but the pressure state detection portion does not detect the pressure released state, the control portion can perform forward rotational direction retry control according to which the cam is again turned in the forward rotational direction after the cam is turned in the backward rotational direction for the second predetermined time period.

Similarly, when shifting from the pressure released state to the pressure applied state, if the cam is turned in the backward rotational direction with respect to the switching portion that is in the pressure released state for the third predetermined time period, but the pressure state detection portion does not detect the pressure applied state, the control portion can perform backward rotational direction retry control according to which the cam is again turned in the backward rotational direction after the cam is turned in the forward rotational direction for the fourth predetermined time period.

Therefore, in the fixing apparatus including the switching portion having the mechanism using the aforementioned turnable cam, even if some problem or the like occurs to the switching portion so that the switching portion enters a locked state, the operations of the switching portion can be recovered with ease by performing the aforementioned forward rotational direction retry control or backward rotational direction retry control. Thus, the stoppage of operations in the fixing apparatus can be easily suppressed. Furthermore, it is not necessary to use a larger scaled motor or the like to turn the aforementioned cam than necessary, thus enabling the suppression of increases in the cost of the fixing apparatus.

DESCRIPTION OF THE PREFERRED EMBODIMENTS

Figure 1:
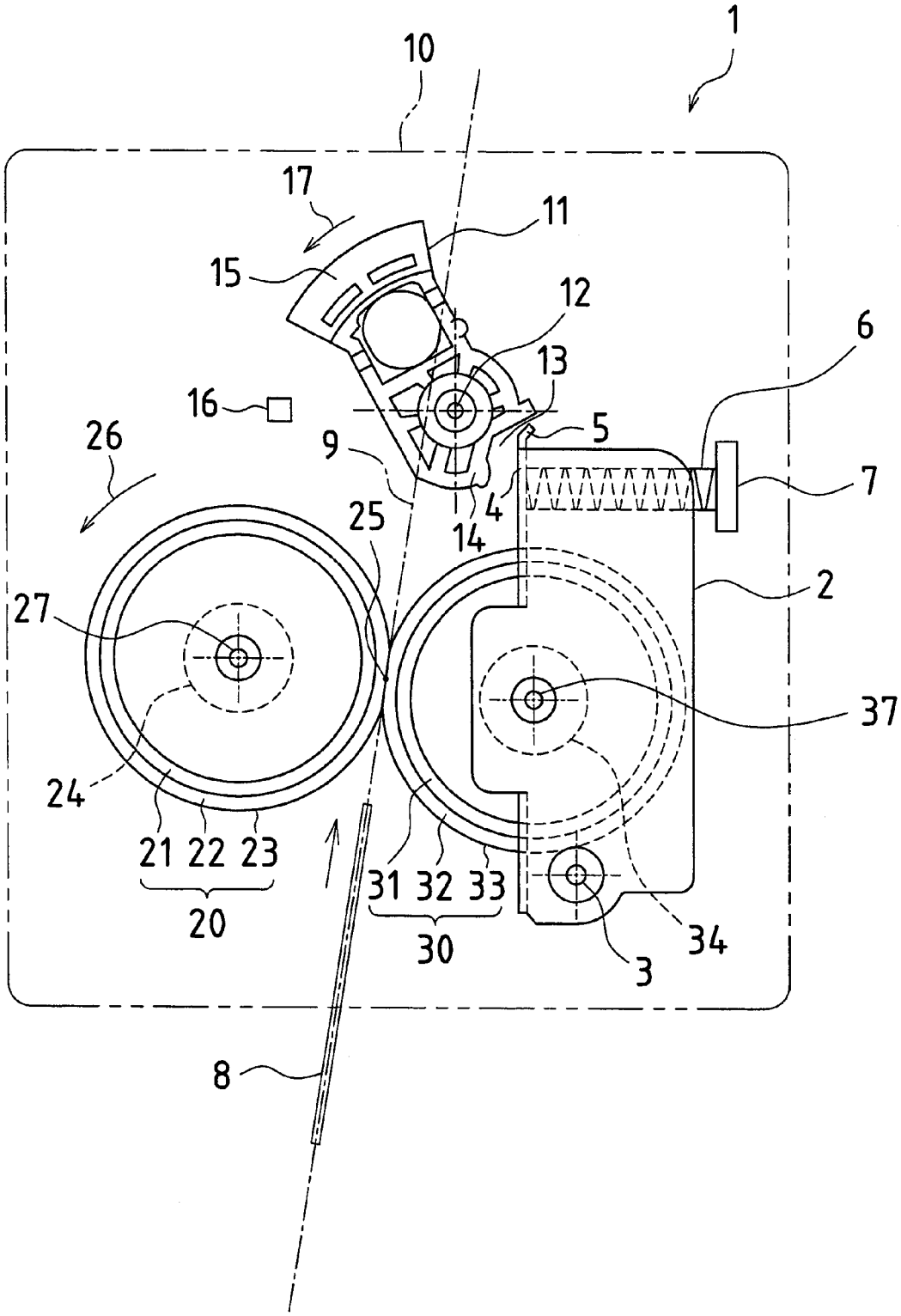
FIG. 1 is a configuration diagram showing the configuration of a fixing apparatus in an embodiment.

A fixing apparatus in an embodiment of the present invention will be described with reference to the drawings. FIG. 1 is a configuration diagram showing the configuration of a fixing apparatus 1 in the present embodiment. In FIG. 1, the fixing apparatus 1 in the present embodiment is mainly configured of a hot roller 20 and a pressure roller 30, which form a pair of rotary bodies, a pressure roller holder 2, a spring 6, a pressure control lever (cam) 11, a sensor 16, and a fixing apparatus chassis 10. The aforementioned pressing portion is mainly configured of a combination of the pressure roller holder 2 and the spring 6 among the above components. Also, the aforementioned switching portion is configured of the pressure control lever 11.

Note that, in FIG. 1, the fixing apparatus chassis 10 is formed in front of the hot roller 20, the pressure roller 30, the pressure roller holder 2, the spring 6, the pressure control lever 11, the sensor 16, and the like, and the fixing apparatus chassis 10 is indicated with an imaginary line in FIG. 1. Also, looking at FIG. 1, the left side represents the front and the right side represents the back in FIG. 1.

The fixing apparatus 1 in the present embodiment presses the pressure roller 30 against the hot roller 20 so as to form a nip portion 25, which is a contact region of both rollers; causes a recording paper 8, on which toner forming a visible image has been transferred, to pass through the nip portion 25; and melts the toner on the recording paper 8 using heat from the hot roller 20 and pressure from the pressure roller 30 so as to fix the image on the recording paper 8. The recording paper 8 is transported from the bottom to the top of FIG. 1 along a recording paper transport path 9.

A hot roller support shaft 27 of the hot roller 20 is rotatably attached to the fixing apparatus chassis 10 so that the hot roller 20 rotates due to a motor (not shown) in the direction indicated by an arrow 26.

The hot roller 20 includes a metal core 21, an elastic body layer 22, and a surface layer 23. A highly thermally conductive metal can be used for the metal that forms the metal core 21, and examples of such metals include aluminum, iron, and the like. Although a shape of the metal core 21 can be cylindrical, cylindraceous, or the like, the shape is preferably cylindrical with the amount of heat discharged from the metal core 21 being small.

Although a material constituting the elastic body layer 22 is not particularly limited as long as the material has rubber elasticity, it is preferable that the material furthermore has high thermal resistance as well. Specific examples of such a material include, for example, silicone rubber, fluoro rubber, fluorosilicone rubber, and the like. Particularly, silicone rubber that has great rubber elasticity is preferable among these.

A material constituting the surface layer 23 is not particularly limited as long as the material has high thermal resistance and durability, and toner tends not to adhere to the material. Examples of such a material include a fluoroplastic material, such as PFA (tetrafluoroethylene-perfluoroalkylvinylether copolymer) or PTFE (polytetrafluoroethylene), fluoro rubber, and the like. In the present embodiment, the surface layer 23 is a PFA layer having a thickness of approximately 40 μm.

A pressure roller support shaft 37 of the pressure roller 30 is rotatably attached in the vicinity of the center of the pressure roller holder 2 so that the pressure roller 30 can freely rotate with respect to the pressure roller holder 2. The pressure roller 30 contacts the rotating hot roller 20 and is driven to rotate due to this contact.

When the hot roller 20 fixes a toner image onto the recording paper 8 by heating, the pressure roller 30 presses the melting toner against the recording paper 8 so as to facilitate fixing of the toner image onto the recording paper 8.

The pressure roller 30 includes a metal core 31, an elastic body layer 32, and a surface layer 33. The same metal or materials that form the metal core 21, the elastic body layer 22, and the surface layer 23 of the hot roller 20 can be respectively used for materials that form the metal core 31, the elastic body layer 32, and the surface layer 33. Also, the shape of the metal core 31 is the same as that of the metal core 21 of the hot roller 20.

Heaters 24 and 34 are provided inside the aforementioned hot roller 20 and pressure roller 30. In the present embodiment, halogen lamps are used for the heaters 24 and 34. The heaters 24 and 34 heat the hot roller 20 and the pressure roller 30. Further, in order to maintain a uniform temperature on the surfaces of the hot roller 20 and the pressure roller 30, temperature sensors (not shown) configured of a thermistor or the like are provided close to the hot roller 20 and the pressure roller 30. The temperatures of the surfaces of the hot roller 20 and the pressure roller 30 are measured using such temperature sensors so that the heaters 24 and 34 are controlled.

The pressure roller holder 2 supports the pressure roller 30 as described above. Note that, as for the pressure roller holder 2, the side where the pressure roller holder 2 is close to the hot roller 20 is referred to as a front side of the pressure roller holder 2 and the opposite side to the front side of the pressure roller holder 2 is referred to as a rear side of the pressure roller holder 2.

The pressure roller holder 2 is provided with a holder support shaft 3 in a position that is on the lower part of the pressure roller holder 2 and is obliquely closer to the lower rear side with respect to the pressure roller support shaft 37. The holder support shaft 3 is turnably attached to the fixing apparatus chassis 10. That is, the pressure roller holder 2 turns with the holder support shaft 3 as a fulcrum. Accordingly, the entire pressure roller 30 turns with the holder support shaft 3 as a fulcrum.

A holder upper portion piece 4 is formed on the upper front side of the pressure roller holder 2, and the upper end thereof bends toward the rear side so as to form a holder upper portion piece end 5. Further, the end of the spring 6 whose base end is fixed with a spring support piece 7 presses against the back face of the holder upper portion piece 4 of the pressure roller holder 2. The spring support piece 7 is fixed on the fixing apparatus chassis 10.

The above spring 6 causes the pressure roller holder 2 to be biased toward the hot roller 20. Since the pressure roller 30 is attached to the pressure roller holder 2, the pressure roller 30 presses against the hot roller 20 due to this bias. The pressure roller 30 presses against the hot roller 20 so that a toner image on the recording paper 8, which passes through the nip portion 25 between the hot roller 20 and the pressure roller 30, can be reliably fixed. The state of the pressure roller 30 in this state is the aforementioned pressure applied state.

As described above, as for the fixing apparatus 1 using the hot roller 20 and the pressure roller 30, in an image forming apparatus and the like using the fixing apparatus 1, when warming up or being on standby, operations in the image forming apparatus having been stopped, or the like, if the pressure roller 30 is maintained for a long time in a state in which the pressure roller 30 is pressing against the hot roller 20, the surface of the hot roller 20 may possibly be deformed. Alternatively, if toner forming a visible image is to be transferred onto an envelope or the like that is thicker than the recording paper 8, excessive force may be exerted onto the envelope or the like in the state in which pressure roller 30 is pressing against the hot roller 20 so that, for example, the envelope or the like may be crumpled.

In view of this, if the time period when the fixing apparatus 1 does not perform a fixing operation is of a certain length, or a toner image formed on an envelop or the like is fixed, pressure applied by the pressure roller 30 against the hot roller 20 can be released so as to maintain the high quality performance of the fixing apparatus 1. That is, providing a mechanism capable of switching the state of the pressure roller 30 between the aforementioned pressure applied state and pressure released state with respect to the hot roller 20 is superior in terms of maintaining the high quality performance of the fixing apparatus 1.

Accordingly, the pressure control lever 11 is used in the aforementioned fixing apparatus 1 in order to switch the state of the pressure roller 30 between the pressure applied state and the pressure released state with respect to the hot roller 20.

The pressure control lever 11 is provided close to the pressure roller holder 2 in a position that is obliquely up toward the front relative to the pressure roller holder 2. The shape of the pressure control lever 11 is similar to a shape constituted from the upper half of a fan shape and the bottom thereof is connected to a plate piece including a plurality of notches that is coarse mesh-shaped. The pressure control lever 11 includes a pressure control lever support shaft 12 on the plate piece portion that is opposite the upper half of the fan shape with the center portion of the pressure control lever 11 therebetween, and the pressure control lever support shaft 12 is turnably attached to the fixing apparatus chassis 10.

As for the pressure control lever 11, the pressure control lever support shaft 12 of the pressure control lever 11 is connected to a pressure control lever drive motor (not shown). Accordingly, the pressure control lever drive motor rotates forward or backward so that the pressure control lever 11 can freely turn with the pressure control lever support shaft 12 as a fulcrum. Note that, in FIG. 1, an arrow 17 indicates a forward rotational direction when the pressure control lever 11 turns.

Also, as can be seen from FIG. 1, on the edge portion of the plate piece portion of the pressure control lever 11, a pressure control lever notch portion 13 and a pressure control lever projecting portion 14 are adjacently formed next to each other in an order corresponding to the clockwise (CW) direction of the pressure control lever support shaft 12 as a fulcrum.

Further, the fan-shaped portion of the pressure control lever 11 is formed as a sensor light reflection piece 15. The sensor light reflection piece 15, as described later, is used to reflect infrared rays irradiated by the sensor 16 when the pressure control lever 11 turns so that the sensor light reflection piece 15 is moved to a position in which the sensor light reflection piece 15 faces the sensor 16.

In the aforementioned fixing apparatus 1, by turning the pressure control lever 11 in the forward rotational direction or in the backward rotational direction, a pressure release operation for shifting from the pressure applied state to the pressure released state and a pressure application operation for shifting from the pressure released state to the pressure applied state are performed so as to perform the above switching.

The state of the pressure control lever 11 as shown in FIG. 1 indicates the pressure applied state. In this state, the position of the pressure control lever 11 is determined so that the holder upper portion piece end 5 of the pressure roller holder 2 is positioned in a space formed in a depressed portion of the pressure control lever notch portion 13 of the pressure control lever 11 (note, also see FIG. 3 for the pressure applied state).

In the pressure applied state, being different from the case of the later-described pressure released state, the pressure control lever projecting portion 14 of the pressure control lever 11 does not press the surface of the holder upper portion piece 4 of the pressure roller holder 2 or the holder upper portion piece end 5 of the pressure roller holder 2. That is, no force pressing the surface of the holder upper portion piece 4 of the pressure roller holder 2 or the holder upper portion piece end 5 of the pressure roller holder 2 is exerted at all onto the pressure roller holder 2.

Therefore, the biasing force provided by the spring 6 is directly conveyed to the pressure roller 30 via the pressure roller holder 2 so that a state in which the pressure roller 30 presses against the hot roller 20 due to the biasing force provided by the spring 6, that is, the pressure applied state is formed. Further, in the pressure applied state, the sensor light reflection piece 15 of the pressure control lever 11 is not in a position in which the sensor light reflection piece 15 faces the sensor 16.

Figure 4:
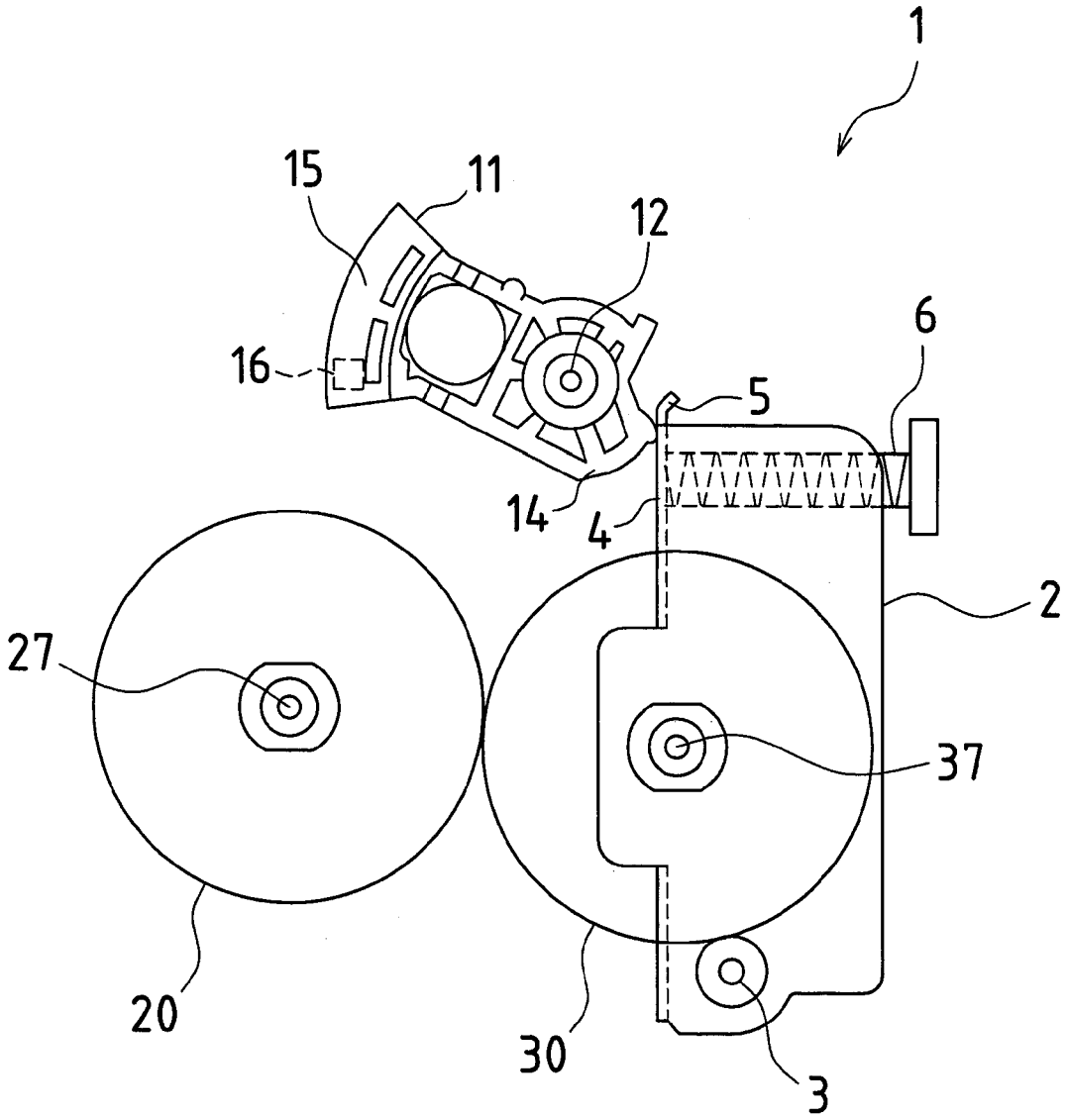
FIG. 4 is a third diagram illustrating the pressure release operation and the pressure application operation performed by the fixing apparatus in the embodiment.
Figure 5:
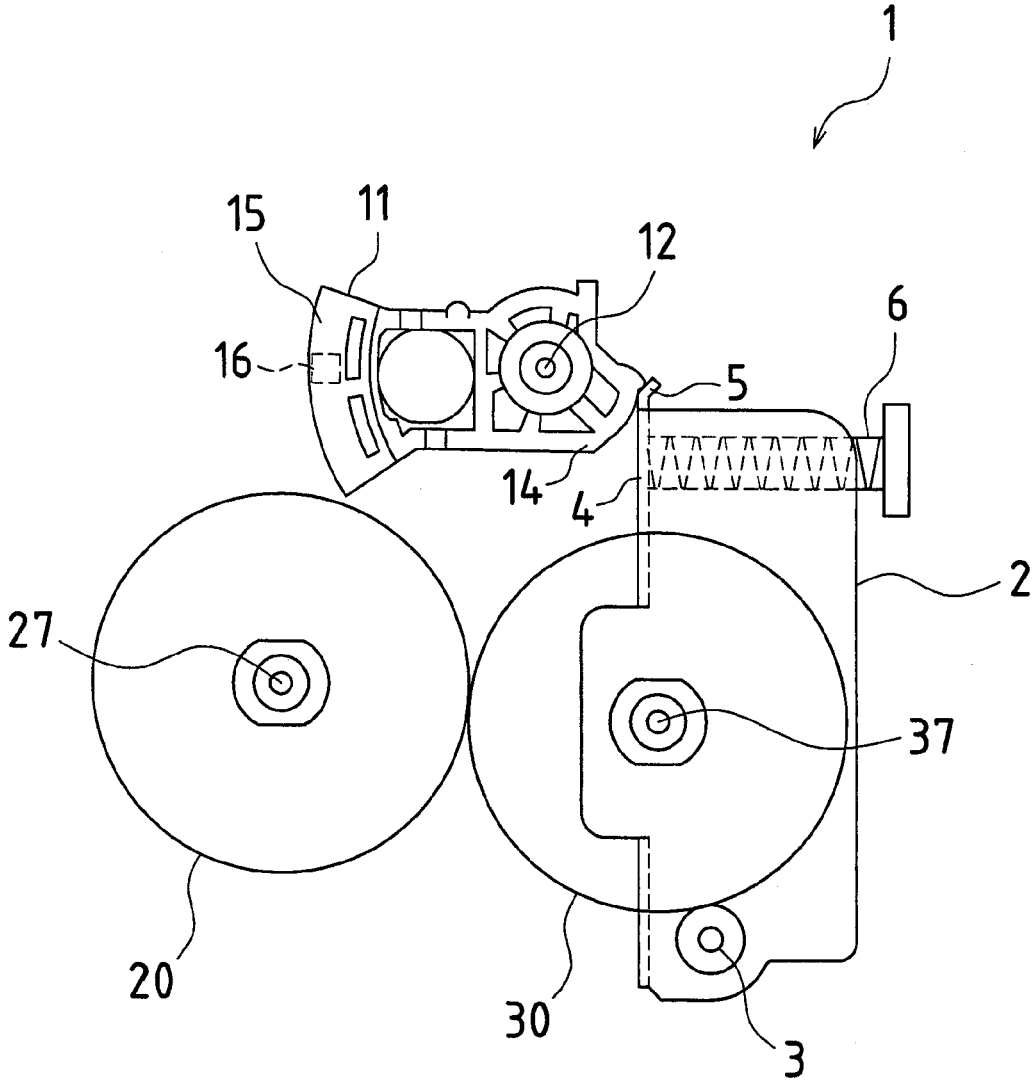
FIG. 5 is a fourth diagram illustrating the pressure release operation and the pressure application operation performed by the fixing apparatus in the embodiment.

On the contrary, in the pressure released state, the pressure control lever projecting portion 14 of the pressure control lever 11 presses the surface of the holder upper portion piece 4 of the pressure roller holder 2 or the holder upper portion piece end 5 of the pressure roller holder 2 (see FIGS. 4 and 5). Due to this pressure, the pressure roller holder 2 is slightly pressed backward so that the pressure applied by the pressure roller 30 with respect to the hot roller 20 is reduced. In the pressure released state, the sensor light reflection piece 15 of the pressure control lever 11 moves to the aforementioned position in which the sensor light reflection piece 15 faces the sensor 16.

The sensor 16 is configured of an infrared ray emitting element and a light receiving element that receives reflected light. That reflected light is an infrared ray that has been emitted by the infrared ray emitting element, reflected on the sensor light reflection piece 15 of the pressure control lever 11, and returned. Note that, a proximity sensor and the like can be used for the sensor 16.

The sensor 16 enters a state in which the light receiving element receives reflected light reflected on the sensor light reflection piece 15 when the sensor light reflection piece 15 of the pressure control lever 11 moves to the position in which the sensor light reflection piece 15 faces the sensor 16. Such reflected light is received, as described above, when the state thereof is the pressure released state, and the sensor output of the sensor 16 is at an "H (high) level". That is, when the sensor output of the sensor 16 is at the "H level", that state indicates that the sensor 16 is detecting the pressure released state.

On the contrary, reflected light is not received in the pressure applied state as described above; thus, the sensor output of the sensor 16 is at an "L (low) level". That is, when the sensor output of the sensor 16 is at the "L level", that state indicates that the sensor 16 is detecting the pressure applied state.

Next, in the aforementioned fixing apparatus 1, the pressure release operation for shifting from the pressure applied state to the pressure released state and the pressure application operation for shifting from the pressure released state to the pressure applied state are described based on the diagrams illustrating an operation shown in FIGS. 2 to 5 and the time charts shown in FIGS. 6A to 6C and FIGS. 7A to 7C.

Figure 2:
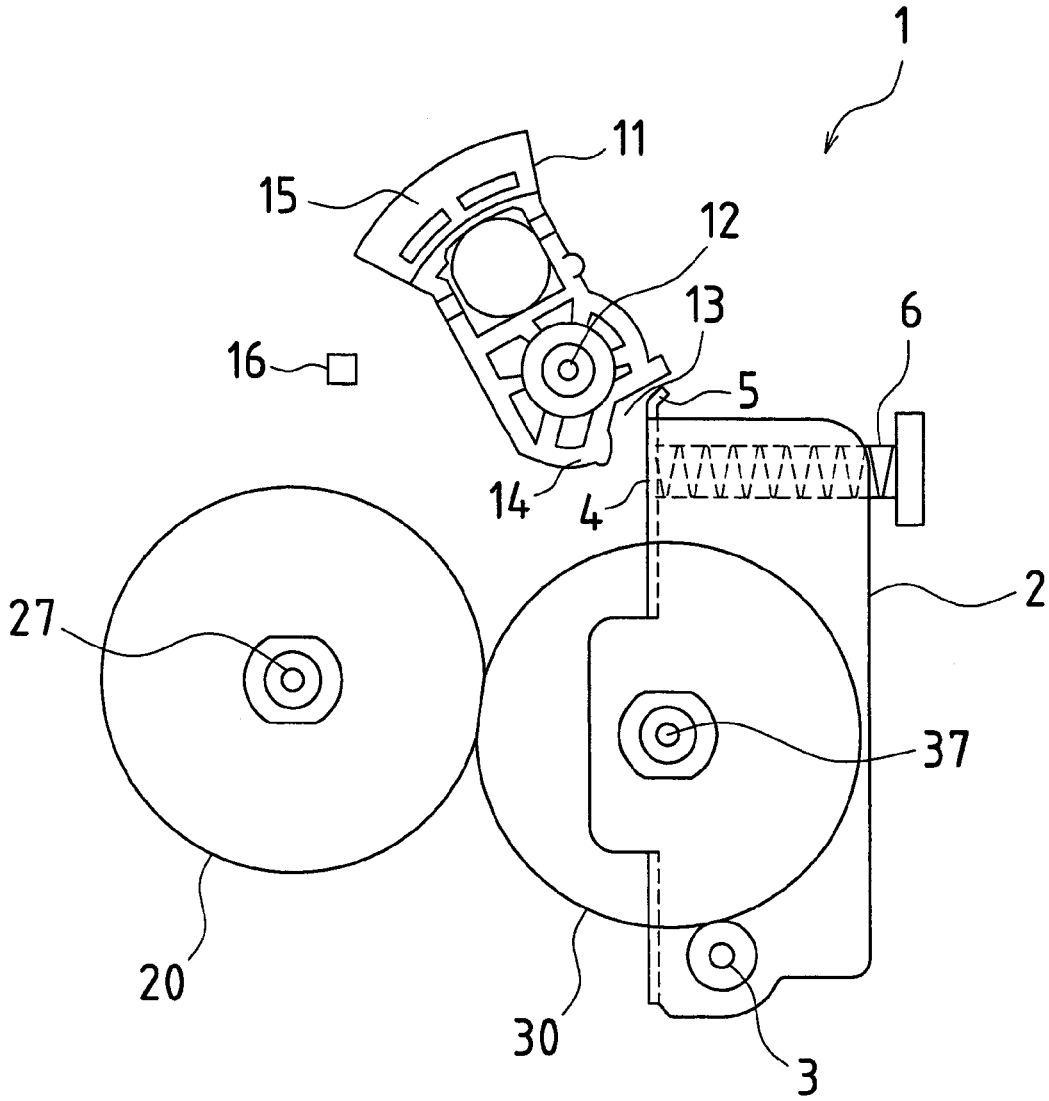
FIG. 2 is a first diagram illustrating a pressure release operation and a pressure application operation performed by the fixing apparatus in the embodiment.

Note that the fixing apparatus chassis 10 is omitted, and part of the fixing apparatus 1 is simplified in the diagrams illustrating an operation shown in FIGS. 2 to 5. The state as shown in FIG. 2 is exactly the same as that shown in FIG. 1 and indicates the pressure applied state.

Figures 6A, 6B, 6C:
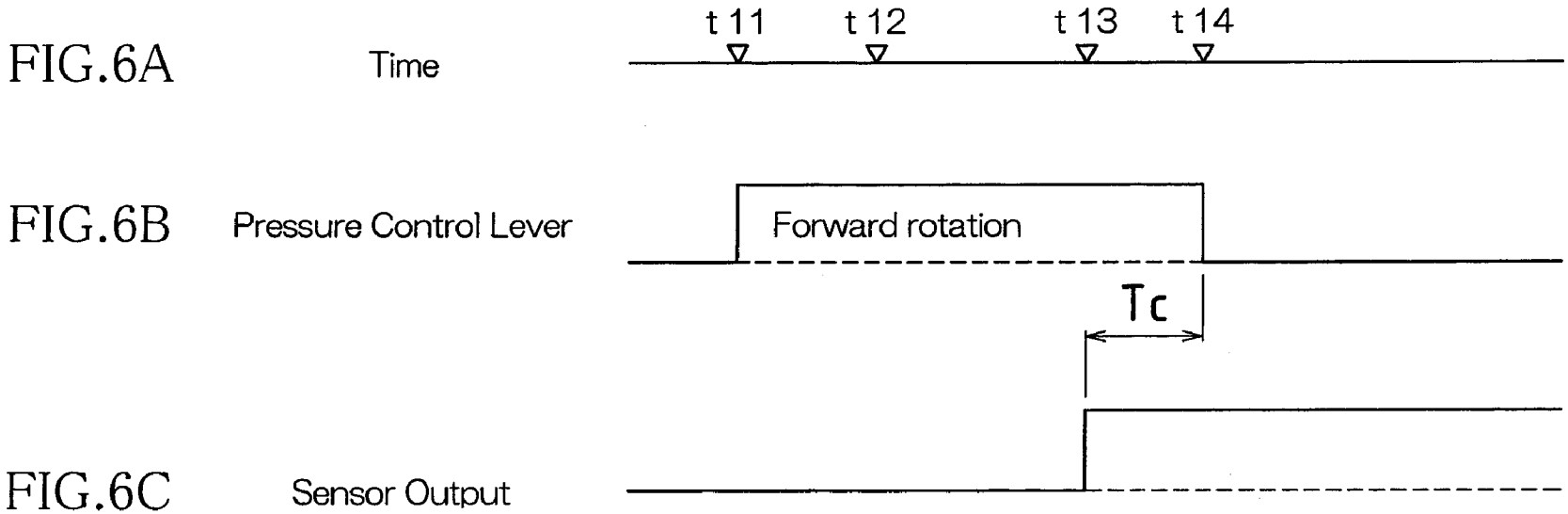
FIGS. 6A to 6C are time charts of pressure release control performed by the fixing apparatus in the embodiment.
Figures 7A, 7B, 7C:
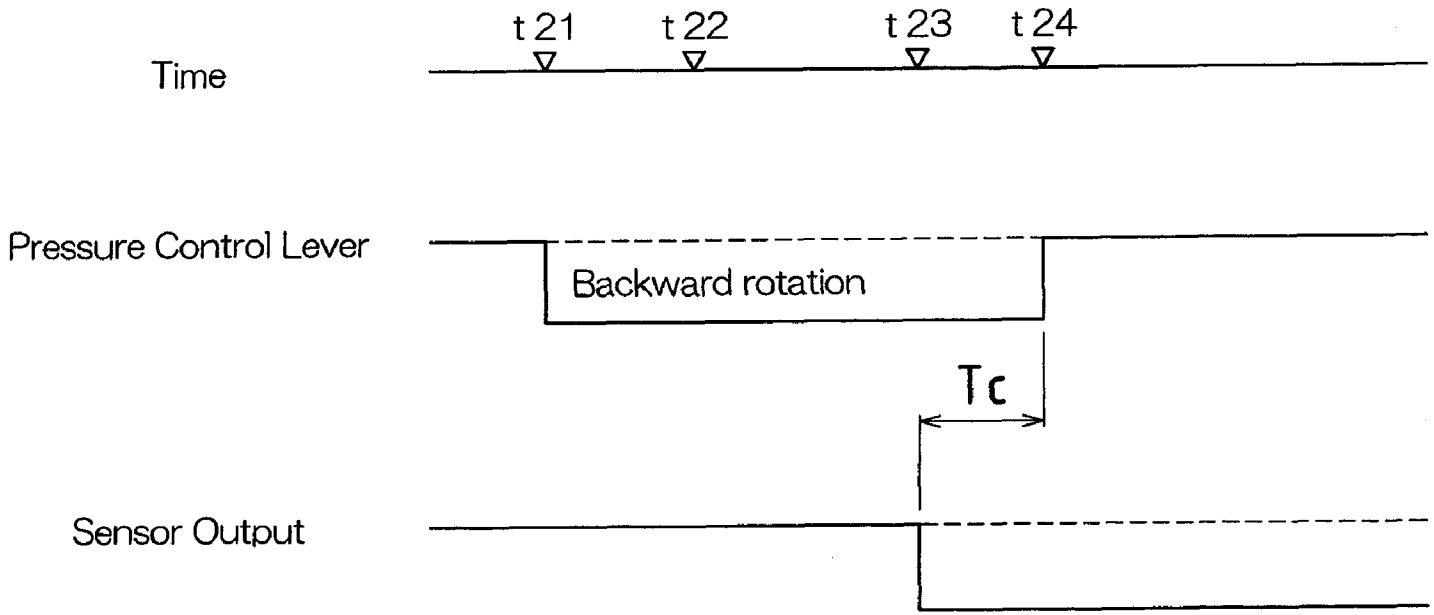
FIGS. 7A to 7C are time charts of pressure application control performed by the fixing apparatus in the embodiment.
Figures 8A, 8B, 8C, 8D:
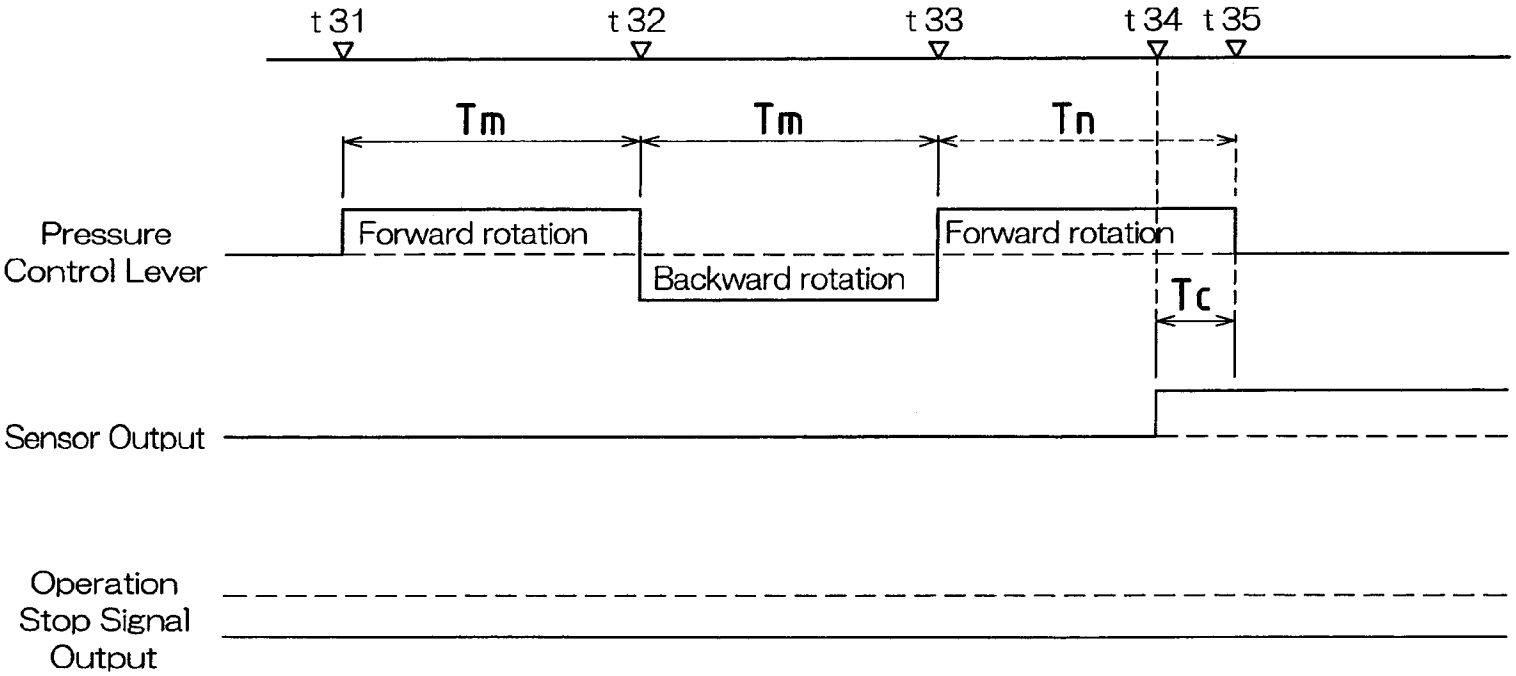
FIGS. 8A to 8D are first time charts in a case in which a locked state occurs when pressure release control is performed by the fixing apparatus in the embodiment.
Figures 9A, 9B, 9C, 9D:
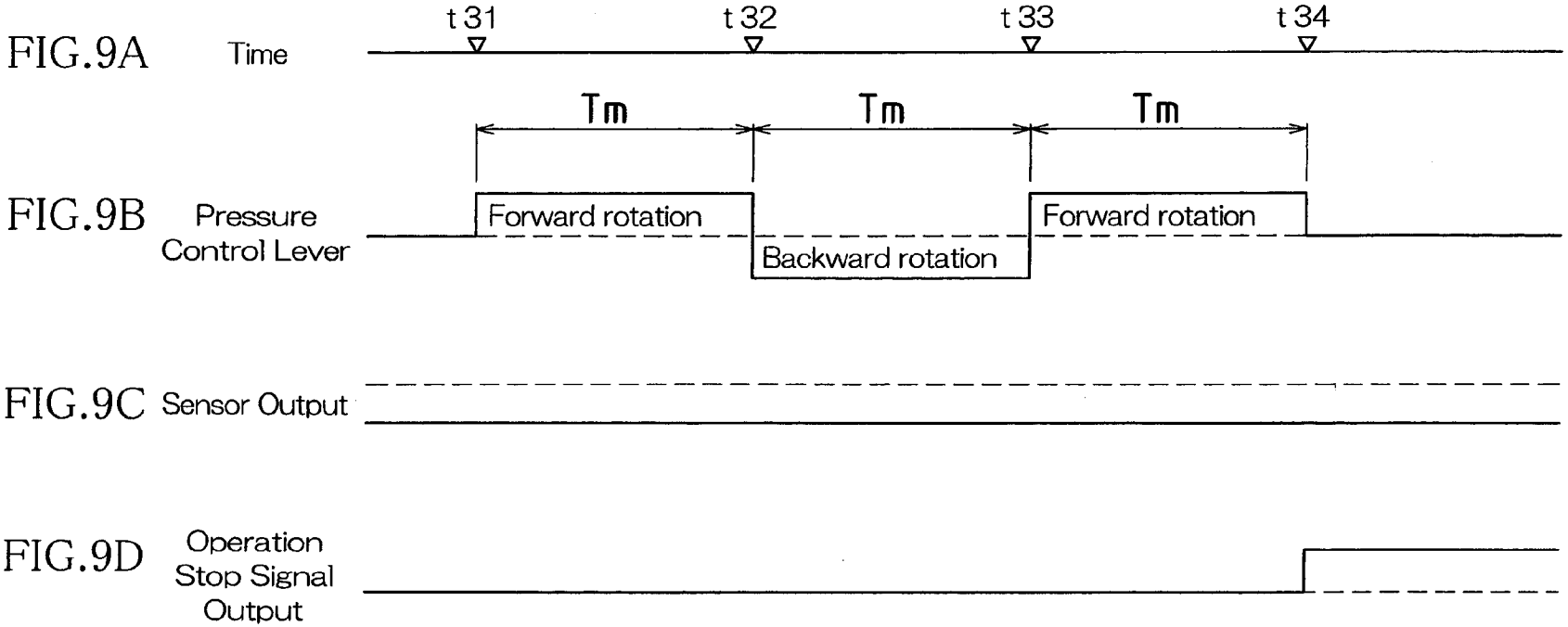
FIGS. 9A to 9D are second time charts in a case in which a locked state occurs when pressure release control is performed by the fixing apparatus in the embodiment.
Figures 10A, 10B, 10C, 10D:
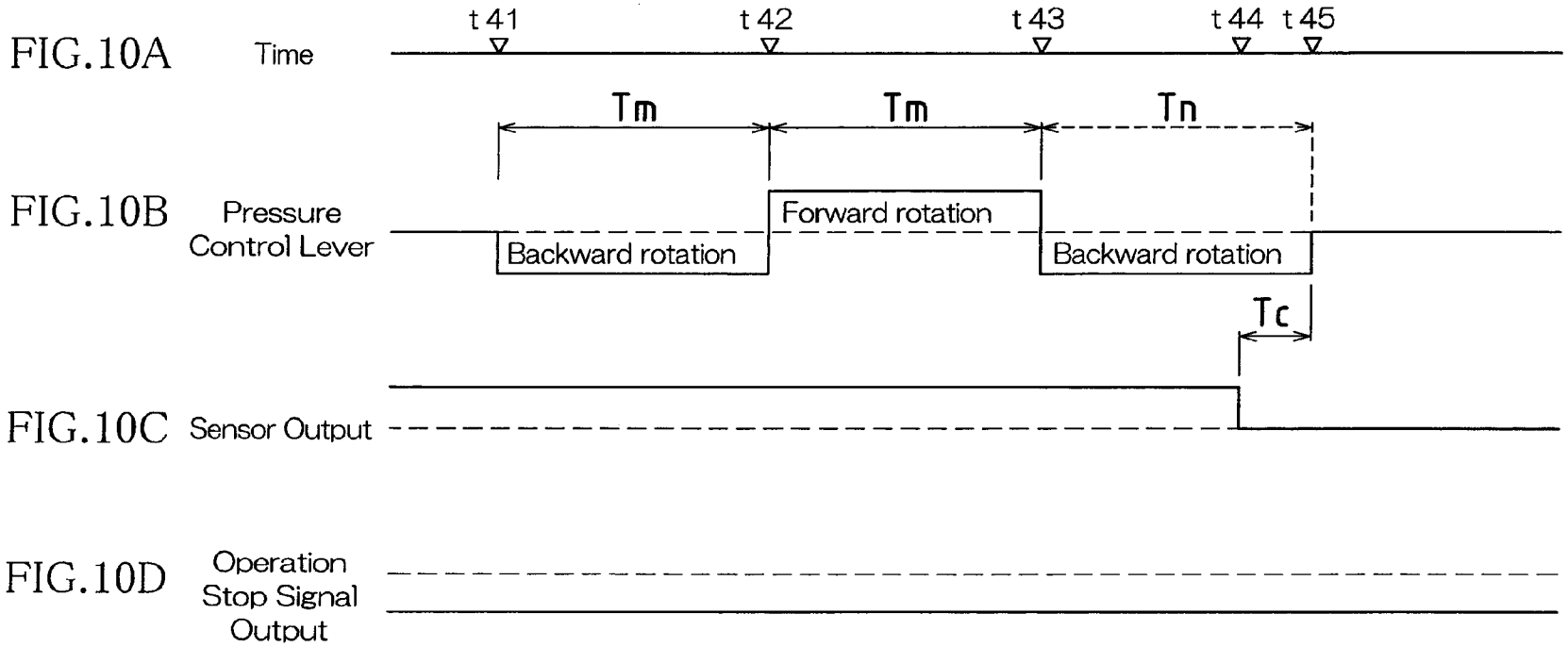
FIGS. 10A to 10D are first time charts in a case in which a locked state occurs when pressure application control is performed by the fixing apparatus in the embodiment.
Figures 11A, 11B, 11C, 11D:
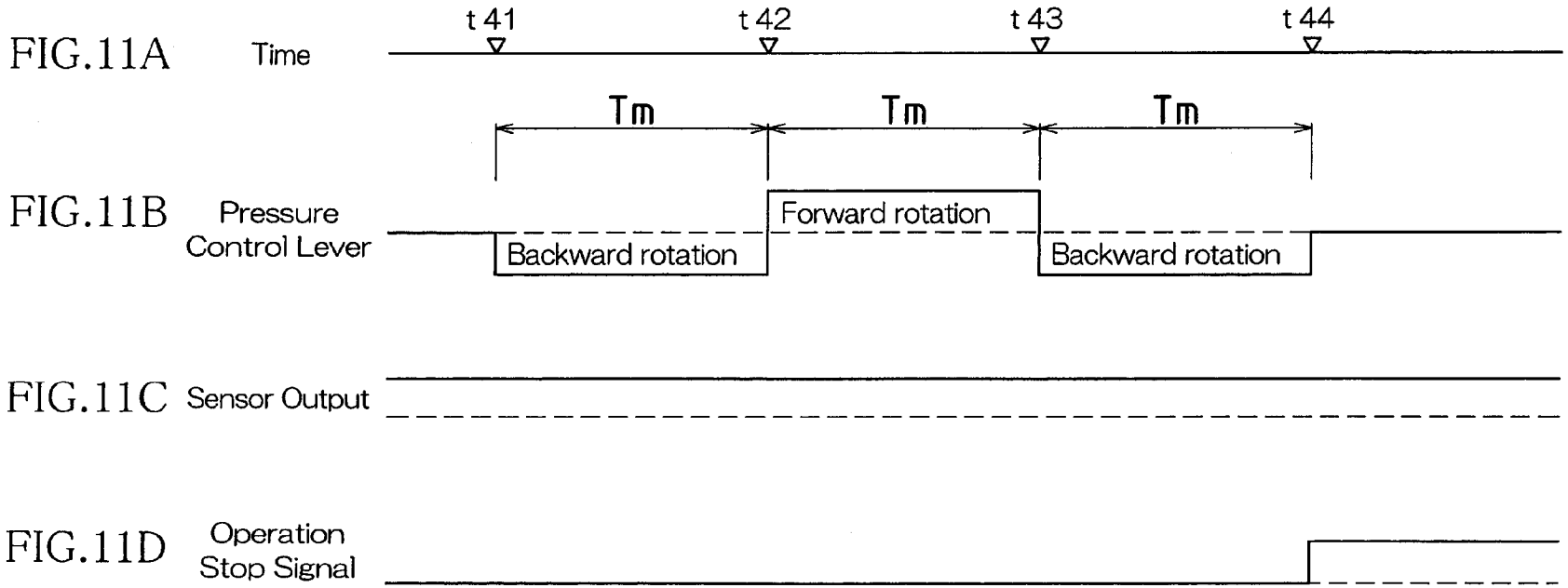
FIGS. 11A to 11D are second time charts in a case in which a locked state occurs when pressure application control is performed by the fixing apparatus in the embodiment.

A control unit (not shown) performs the aforementioned pressure release operation and pressure application operation based on a signal from the sensor 16 by rotating the pressure control lever drive motor forward or backward so as to turn the pressure control lever 11 in the forward direction or in the backward direction. Control of the pressure release operation by the control unit is referred to as pressure release control, and control of the pressure application operation is referred to as pressure application control. FIGS. 6A to 6C show time charts of pressure release control, and FIGS. 7A to 7C show time charts of pressure application control.

First, when the fixing apparatus 1 is in the pressure applied state, pressure release control for shifting from the pressure applied state to the pressure released state will be described. FIG. 2 shows the pressure applied state of the fixing apparatus 1. In this state, the output of the sensor 16 is at the "L level". In this state, the control unit rotates the pressure control lever drive motor forward so as to turn the pressure control lever 11 in the forward rotational direction (the direction indicated by the arrow 17 in FIG. 1) (t11 in FIGS. 6A to 6C).

Figure 3:
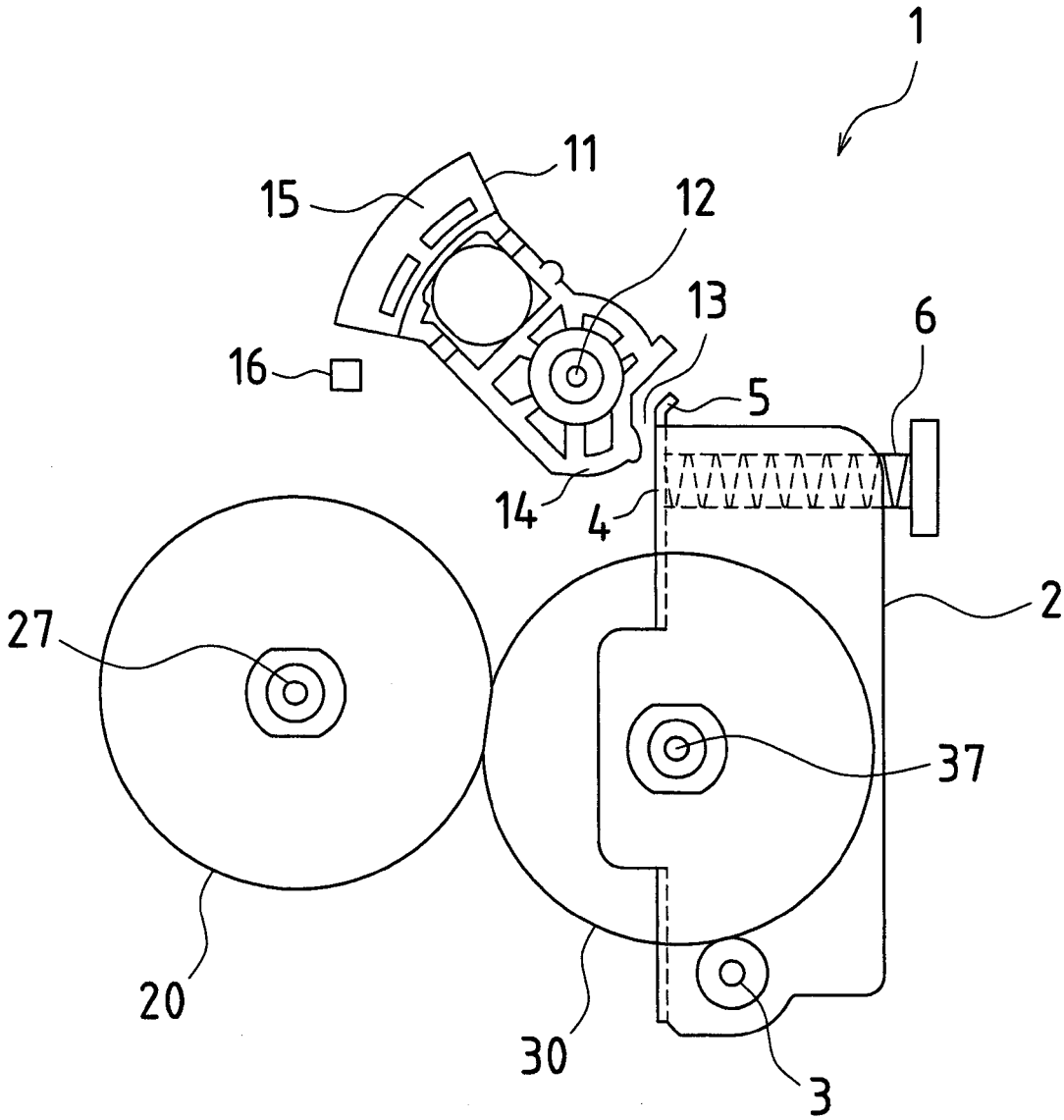
FIG. 3 is a second diagram illustrating the pressure release operation and the pressure application operation performed by the fixing apparatus in the embodiment.

Thereby, the pressure control lever 11 turns in the forward rotational direction so as to enter the state as shown in FIG. 3 (t12 in FIGS. 6A to 6C). In this state, since the pressure control lever projecting portion 14 of the pressure control lever 11 is not pressing the surface of the holder upper portion piece 4 of the pressure roller holder 2, the fixing apparatus 1 is still in the pressure applied state.

The pressure control lever 11 further turns in the forward rotational direction so as to enter the state as shown in FIG. 4 (t13 in FIGS. 6A to 6C). In this state, the pressure control lever projecting portion 14 of the pressure control lever 11 is pressing the surface of the holder upper portion piece 4 of the pressure roller holder 2. Due to this pressure, the pressure roller holder 2 is slightly pressed backward so that the pressure applied by the pressure roller 30 with respect to the hot roller 20 is reduced; thus, the fixing apparatus 1 enters the pressure released state.

In this state, the sensor 16 receives reflected light from the sensor light reflection piece 15 of the pressure control lever 11 so that the sensor output reaches the "H level". Then, when a certain time period (Tc in FIGS. 6A to 6C) elapses from when the sensor output reaches the "H level", the control unit stops the pressure control lever drive motor so as to stop the pressure control lever 11 (t14 in FIGS. 6A to 6C).

Until entering such a state (t14 in FIGS. 6A to 6C), the pressure control lever drive motor rotates forward so that the pressure control lever 11 turns in the forward rotational direction; thus, the fixing apparatus 1 enters the state as shown in FIG. 5. In the state as shown in FIG. 5, the pressure control lever projecting portion 14 of the pressure control lever 11 is pressing the holder upper portion piece end 5 of the pressure roller holder 2. Thus, the state as shown in FIG. 5 is a state in which the pressure released state is maintained.

Next, when the fixing apparatus 1 is in the pressure released state, pressure application control for shifting from the pressure released state to the pressure applied state will be described. The exact opposite control to the aforementioned pressure release control is performed for such pressure application control. FIG. 5 shows the pressure released state of the fixing apparatus 1.

That is, in this state, the pressure control lever projecting portion 14 of the pressure control lever 11 is pressing the holder upper portion piece end 5 of the pressure roller holder 2, and the pressure roller holder 2 is slightly pressed backward due to this pressure so that pressure applied by the pressure roller 30 with respect to the hot roller 20 is reduced. The output of the sensor 16 is at the "H lever" in this state.

In the pressure released state, the control unit rotates the pressure control lever drive motor backward so as to turn the pressure control lever 11 in the backward rotational direction (the direction opposite to the direction indicated by the arrow 17 in FIG. 1) (t21 in FIGS. 7A to 7C).

Thereby, the pressure control lever 11 turns in the backward rotational direction so as to enter the state as shown in FIG. 4 (t22 in FIGS. 7A to 7C). In this state, the pressure control lever projecting portion 14 of the pressure control lever 11 is pressing the surface of the holder upper portion piece 4 of the pressure roller holder 2 so that the fixing apparatus 1 is still in the pressure released state.

The pressure control lever 11 further turns in the backward rotational direction so as to enter the state as show in FIG. 3 (t23 in FIGS. 7A to 7C). This state is not a state in which the pressure control lever projecting portion 14 of the pressure control lever 11 is pressing the surface of the holder upper portion piece 4 of the pressure roller holder 2. Thus, the surface of the holder upper portion piece 4 of the pressure roller holder 2 is not being pressed so that the fixing apparatus 1 enters the pressure applied state.

In this state, the sensor 16 does not receive reflected light from the sensor light reflection piece 15 of the pressure control lever 11 so that the sensor output reaches the "L level". Then, when a certain time period (Tc in FIGS. 7A to 7C) elapses from when the sensor output reaches the "L level", the control unit stops the pressure control lever drive motor so as to stop the pressure control lever 11 (t24 in FIGS. 7A to 7C).

Until entering such a state (t24 in FIGS. 7A to 7C), the pressure control lever drive motor rotates backward so that the pressure control lever 11 turns in the backward rotational direction; thus, the fixing apparatus 1 enters the state as shown in FIG. 2. The state as shown in FIG. 2 is not a state in which the pressure control lever projecting portion 14 of the pressure control lever 11 is pressing the surface of the holder upper portion piece 4 of the pressure roller holder 2 so that the surface of the holder upper portion piece 4 of the pressure roller holder 2 is not being pressed. Thus, the state as shown in FIG. 2 is a state in which the pressure applied state is maintained.

Note that, the length of time between t21 and t24 in FIGS. 7A to 7C is substantially the same as the length of time between t11 and t14 in FIGS. 6A to 6C. That is, the necessary time required for pressure release control is substantially as long as the necessary time required for pressure application control.

As described above, when the pressure release operation and the pressure application operation are performed in the aforementioned fixing apparatus 1 in the present embodiment, the pressure control lever 11 turns in the forward rotational direction or the backward rotational direction due to the pressure control lever drive motor. At this time, some problem or the like may occur to the pressure control lever 11 serving as a kind of cam so that the mechanism of the pressure control lever 11 enters a locked state, possibly resulting in a state in which operations cannot be performed using the pressure control lever 11.

In such a case, on detecting the locked state of a pressure control lever 11, control units conventionally stopped operations in the fixing apparatus 1.

However, if such a locked state as described above occurred to the pressure control lever 11, a mechanism with which such a state can be recovered with ease is provided in the aforementioned fixing apparatus 1 in the present embodiment. Next, the mechanism with which the locked state of the pressure control lever 11 is recovered will be described.

Note that, even if the fixing apparatus 1 includes the above mechanism, there is a possibility that the locked state cannot be recovered. Thus, the control unit includes a function for outputting an operation stop signal for stopping operations in the fixing apparatus 1 in case a locked state cannot be recovered from. The operation stop signal output is normally at an "L level" and reaches an "H level" when stopping operations in the fixing apparatus 1.

Next, as for the case in which the pressure control lever 11 of the fixing apparatus 1 enters a locked state, first, the case in which the pressure control lever 11 enters a locked state when pressure release control for shifting from the pressure applied state to the pressure released state is performed will be described. FIGS. 8A to 8D show time charts in the case in which the aforementioned locked state occurs when pressure release control is performed.

If a locked state occurs when pressure release control is preformed, processing is performed as follows. In the aforementioned fixing apparatus 1, first, the control unit starts pressure release control with the pressure control lever 11 in the pressure applied state. That is, the pressure control lever drive motor is caused to rotate forward so that the pressure control lever 11 starts to turn in the forward rotational direction (t31 in FIGS. 8A to 8D). When a locked state occurs in this state, even if the turning in the forward rotational direction is continued for a certain time period (Tm in FIGS. 8A to 8D), the sensor output of the sensor 16 does not reach the "H level" due to the above locked state, that is, the sensor 16 does not detect the pressure released state (t32 in FIGS. 8A to 8D).

Note that, the above certain time period (Tm in FIGS. 8A to 8D) is substantially as long as the time between t11 and t14 in FIGS. 6A to 6C described above (that is, Tn in FIGS. 8A to 8D) or the time between t21 and t24 in FIGS. 7A to 7C described above. That is, the above certain time period (Tm in FIGS. 8A to 8D) is sufficient for the sensor 16 to detect the pressure released state after the pressure control lever 11 starts to turn in the forward rotational direction.

In this state, the control unit immediately performs forward rotational direction retry control once (t32 to t33 in FIGS. 8A to 8D). That is, with respect to the pressure control lever 11, first, the pressure control lever drive motor is caused to rotate backward once so as to turn the pressure control lever 11 in the backward rotational direction for a certain time period (Tm in FIGS. 8A to 8D) (t32 in FIGS. 8A to 8D). After that, the pressure control lever drive motor is caused to rotate forward again so as to turn the pressure control lever 11 in the forward rotational direction (t33 in FIGS. 8A to 8D).

If the locked state of the pressure control lever 11 is released by performing forward rotational direction retry control, the sensor output of the sensor 16 reaches the "H level", that is, the sensor 16 detects the pressure released state (t34 in FIGS. 8A to 8D). Thereby, the aforementioned pressure release control ends normally (t35 in FIGS. 8A to 8D). Therefore, the operation stop signal output does not reach the "H level", but remains at the "L level" in this case.

FIGS. 9A to 9D show time charts in the case in which a locked state of the pressure control lever 11 is not released by performing the aforementioned forward rotational direction retry control. Accordingly, t31 to t33 in FIGS. 9A to 9D are the same as those in the time charts in FIGS. 8A to 8D. In FIGS. 9A to 9D, if the locked state of the pressure control lever 11 is not released (t34 in FIGS. 9A to 9D) even by performing the aforementioned forward rotational direction retry control (t32 to t33 in FIGS. 9A to 9D), the control unit stops operations in the fixing apparatus 1. That is, the operation stop signal output reaches the "H level" (t34 in FIGS. 9A to 9D).

Next, in the fixing apparatus 1, the case in which the pressure control lever 11 enters a locked state when pressure application control for shifting from the pressure released state to the pressure applied state is performed will be described. FIGS. 10A to 10D show time charts in the case in which the above locked state occurs when pressure application control is performed.

If the locked state occurs when pressure application control is performed, processing is performed as follows. In the aforementioned fixing apparatus 1, the control unit starts pressure application control with the pressure control lever 11 in the pressure released state. That is, the pressure control lever drive motor is caused to rotate backward so that the pressure control lever 11 starts to turn in the backward rotational direction (t41 in FIGS. 10A to 10D). When a locked state occurs in this state, even if the turning in the backward rotational direction is continued for a certain time period (Tm in FIGS. 10A to 10D), the sensor output of the sensor 16 does not reach the "L level" due to the above locked state, that is, the sensor 16 does not detect the pressure applied state (t42 in FIGS. 10A to 10D).

Note that, the above certain time period (Tm in FIGS. 10A to 10D) is substantially as long as the time between till and t14 in FIGS. 6A to 6C described above or the time between t21 and t24 in FIGS. 7A to 7C described above (that is, Tn in FIGS. 10A to 10D). That is, the above certain time period (Tm in FIGS. 10A to 10D) is sufficient for the sensor 16 to detect the pressure applied state after the pressure control lever 11 starts to turn in the backward rotational direction.

In this state, the control unit immediately performs backward rotational direction retry control once (t42 to t43 in FIGS. 10A to 10D). That is, with respect to the pressure control lever 11, first, the pressure control lever drive motor is caused to rotate forward once so as to turn the pressure control lever 11 in the forward rotational direction for a certain time period (Tm in FIGS. 10A to 10D) (t42 in FIGS. 10A to 10D). After that, the pressure control lever drive motor is caused to rotate backward again so as to turn the pressure control lever 11 in the backward rotational direction (t43 in FIGS. 10A to 10D).

If the locked state of the pressure control lever 11 is released by performing backward rotational direction retry control, the sensor output of the sensor 16 reaches the "L level", that is, the sensor 16 detects the pressure applied state (t44 in FIGS. 10A to 10D). Thereby, the aforementioned pressure application control ends normally (t45 in FIGS. 10A to 10D). Therefore, the operation stop signal output does not reach the "H level", but remains at the "L level" in this case.

FIGS. 11A to 11D show time charts in the case in which a locked state of the pressure control lever 11 is not released by performing the aforementioned backward rotational direction retry control. Accordingly, t41 to t43 in FIGS. 11A to 11D are the same as those in the time charts in FIGS. 10A to 10D. In FIGS. 11A to 11D, if the locked state of the pressure control lever 11 is not released (t44 in FIGS. 11A to 11D) even by performing the aforementioned backward rotational direction retry control (t42 to t43 in FIGS. 11A to 11D), the control unit stops operations in the fixing apparatus 1. That is, the operation stop signal output reaches the "H level" (t44 in FIGS. 11A to 11D).

According to the aforementioned fixing apparatus 1 in the present embodiment, when the state is shifted from the pressure applied state to the pressure released state, the control unit can perform forward rotational direction retry control according to which if the pressure control lever 11 in the pressure applied state is caused to turn in the forward rotational direction for a certain time period, but the sensor 16 does not detect the pressure released state, the pressure control lever 11 is again caused to turn in the forward rotational direction after the pressure control lever 11 is caused to turn in the backward rotational direction for a certain time period.

Also, similarly to the case of shifting from the pressure applied state to the pressure released state, when the state is shifted from the pressure released state to the pressure applied state, the control unit can perform backward rotational direction retry control according to which if the pressure control lever 11 in the pressure released state is caused to turn in the backward rotational direction for a certain time period, but the sensor 16 does not detect the pressure applied state, the pressure control lever 11 is again caused to turn in the backward rotational direction after the pressure control lever 11 is caused to turn in the forward rotational direction for a certain time period.

Therefore, in the fixing apparatus 1, even if some problem or the like occurs to the pressure control lever 11 so that the pressure control lever 11 enters a locked state, the pressure control lever 11 can be recovered with ease by performing forward rotational direction retry control or backward rotational direction retry control.

Accordingly, stoppage of operations in the fixing apparatus 1 can be easily suppressed, and it is not necessary to use a larger scaled motor or the like to turn the pressure control lever 11 than necessary, thus enabling the suppression of increases in the cost of the fixing apparatus 1.

In the aforementioned fixing apparatus 1 in the present embodiment, when pressure release control for shifting from the pressure applied state to the pressure released state is performed, if the pressure control lever 11 enters a locked state, the control unit performs forward rotational direction retry control once. If the locked state is not released thereby, operations in the fixing apparatus 1 are stopped. However, forward rotational direction retry control may be performed a predetermined plurality of times in this case.

For example, the control unit may include a counter that is configured of hardware or software so as to count the number of instances of forward rotational direction retry control using the counter. Then, even if a locked state is not released after the number of instances has reached the predetermined number, operations in the fixing apparatus 1 may be stopped.

If the pressure control lever 11 enters a locked state when pressure application control for shifting from the pressure released state to the pressure applied state is performed in the fixing apparatus 1, the above method for performing such retry control a plurality of times can also be used in a similar way to that described above.

The present invention may be embodied in various other forms without departing from the spirit or essential characteristics thereof. The embodiments disclosed in this application are to be considered in all respects as illustrative and not limiting. The scope of the present invention is indicated by the appended claims rather than by the foregoing description, and all modifications or changes that come within the meaning and range of equivalency of the claims are intended to be embraced therein.

What is claimed is:

1. A fixing apparatus that causes a recording material to pass through a nip portion formed by a rotating hot roller and a rotating pressure roller being in contact so as to perform a fixing operation to fix an unfixed image on the recording material, the fixing apparatus comprising:

a pressing portion for applying bias to the pressure roller toward the hot roller so as to create a pressure applied state by pressing the pressure roller against the hot roller, a switching portion, including a turnable cam, for switching to a pressure released state in which a pressing force applied by the pressure roller toward the hot roller is reduced by turning the cam in a forward rotational direction with respect to the pressing portion that is in the pressure applied state so that the pressure roller applies pressure to the pressing portion in a direction opposite to a direction in which the bias is applied to the pressure roller so as to press the pressing portion back, and switching to the pressure applied state by turning the cam in a backward rotational direction with respect to the pressing portion that is in the pressure released state so as to release the pressure to the pressing portion;

a pressure state detection portion for detecting the pressure applied state and the pressure released state; and a control portion for controlling processing for, when shifting from the pressure applied state to the pressure released state, turning the cam in the forward rotational direction with respect to the switching portion that is in the pressure applied state and stopping the cam after the pressure state detection portion detects the pressure released state, and when shifting from the pressure released state to the pressure applied state, turning the cam in the backward rotational direction with respect to the switching portion that is in the pressure released state and stopping the cam after the pressure state detection portion detects the pressure applied state, wherein, when shifting from the pressure applied state to the pressure released state, where the cam is turned in the forward rotational direction with respect to the switching portion that is in the pressure applied state for a first predetermined time period, but the pressure state detection portion does not detect the pressure released state, the control portion performs forward rotational direction retry control according to which the cam is again turned in the forward rotational direction after the cam is turned in the backward rotational direction for a second predetermined time period.

2. The fixing apparatus according to claim 1, wherein the first predetermined time period is sufficient for the pressure state detection portion to detect the pressure released state after the cam starts to turn in the forward rotational direction, and the second predetermined time period is substantially as long as the first predetermined time period.

3. The fixing apparatus according to claim 1, wherein the control portion stops an operation in the fixing apparatus where the forward rotational direction retry control is performed a predetermined number of times, but the pressure state detection portion does not detect the pressure released state.

4. The fixing apparatus according to claim 1, wherein when shifting from the pressure released state to the pressure applied state, where the cam is turned in the backward rotational direction with respect to the switching portion that is in the pressure released state for a third predetermined time period, but the pressure state detection portion does not detect the pressure applied state, the control portion performs backward rotational direction retry control according to which the cam is again turned in the backward rotational direction after the cam is turned in the forward rotational direction for a fourth predetermined time period.

5. The fixing apparatus according to claim 4, wherein the third predetermined time period is sufficient for the pressure state detection portion to detect the pressure applied state after the cam starts to turn in the backward rotational direction, and the fourth predetermined time period is substantially as long as the third predetermined time period.

6. The fixing apparatus according to claim 4, wherein the control portion stops an operation in the fixing apparatus where the backward rotational direction retry control is performed a predetermined number of times, but the pressure state detection portion does not detect the pressure applied state.

7. The fixing apparatus according to claim 5, wherein the control portion stops an operation in the fixing apparatus where the backward rotational direction retry control is performed a predetermined number of times, but the pressure state detection portion does not detect the pressure applied state.

* * * * *